US009698478B2

(12) United States Patent
Manasson et al.

(10) Patent No.: US 9,698,478 B2
(45) Date of Patent: Jul. 4, 2017

(54) ELECTRONICALLY-CONTROLLED STEERABLE BEAM ANTENNA WITH SUPPRESSED PARASITIC SCATTERING

(71) Applicant: SIERRA NEVADA CORPORATION, Sparks, NV (US)

(72) Inventors: Vladimir A. Manasson, Irvine, CA (US); Lev S. Sadovnik, Irvine, CA (US); Vladimir Litvinov, Aliso Viejo, CA (US)

(73) Assignee: SIERRA NEVADA CORPORATION, Sparks, NV (US)

( * ) Notice: Subject to any disclaimer, the term of this patent is extended or adjusted under 35 U.S.C. 154(b) by 476 days.

(21) Appl. No.: 14/295,920

(22) Filed: Jun. 4, 2014

(65) Prior Publication Data

US 2015/0357711 A1 Dec. 10, 2015

(51) Int. Cl.

| | |
|---|---|
| ***H01Q 3/00*** | (2006.01) |
| ***H01Q 3/02*** | (2006.01) |
| ***H01Q 3/34*** | (2006.01) |
| ***H01Q 3/24*** | (2006.01) |
| ***H01Q 3/32*** | (2006.01) |

(52) U.S. Cl.
CPC ..... *H01Q 3/34* (2013.01); *H01Q 3/24* (2013.01); *H01Q 3/32* (2013.01)

(58) Field of Classification Search
CPC ..... H01Q 3/24; H01Q 3/26
USPC ..... 342/81, 157, 372–374; 343/731, 826
See application file for complete search history.

(56) References Cited

U.S. PATENT DOCUMENTS

| | | | |
|---|---|---|---|
| 5,214,436 | A | 5/1993 | Hannan |
| 5,515,059 | A | 5/1996 | How et al. |
| 5,886,670 | A | 3/1999 | Manasson et al. |
| 6,127,987 | A | 10/2000 | Maruyama et al. |
| 6,317,095 | B1 | 11/2001 | Teshirogi et al. |
| 6,587,076 | B2 | 7/2003 | Fujii et al. |
| 6,737,938 | B2 | 5/2004 | Kitamori et al. |

(Continued)

FOREIGN PATENT DOCUMENTS

| | | |
|---|---|---|
| EP | 1717903 | 11/2006 |
| JP | 2007258863 | 10/2007 |

OTHER PUBLICATIONS

International Search Report on corresponding PCT application (PCT/US2015/032982) from International Searching Authority (KIPO) dated Aug. 28, 2015.

(Continued)

*Primary Examiner* — Dao Phan
(74) *Attorney, Agent, or Firm* — Klein, O'Neil & Singh, LLP

(57) ABSTRACT

An electronically-controlled steerable beam antenna with suppressed parasitic scattering includes a feed line defining an axis x; and first and second arrays of electronically-controlled switchable scatters distributed along the axis x, each of the scatterers in the first and second arrays being switchable between a high state and a low state to scatter an electromagnetic wave propagating through the transmission line so as to form a steerable antenna beam. Each of the scatters of the second array is configured to be 180°-phase-shifted relative to a corresponding scatter of the first array. The switchable scatterers of the first and second arrays are configured into high states and low states relative to each other so as to suppress parasitic scattering of the electromagnetic wave without suppressing the steerable antenna beam.

23 Claims, 5 Drawing Sheets

(56) References Cited

U.S. PATENT DOCUMENTS

| | | | |
|---|---|---|---|
| 7,151,499 | B2 | 12/2006 | Avakian et al. |
| 7,609,223 | B2 | 10/2009 | Manasson et al. |
| 7,667,660 | B2 | 2/2010 | Manasson et al. |
| 7,777,286 | B2 | 8/2010 | Manasson et al. |
| 7,995,000 | B2 | 8/2011 | Manasson et al. |
| 8,456,360 | B2 | 6/2013 | Manasson et al. |
| 2008/0088510 | A1 | 4/2008 | Murata et al. |
| 2011/0248898 | A1 | 10/2011 | Rothwell et al. |

OTHER PUBLICATIONS

Written Opinion on corresponding PCT application (PCT/US2015/032982) from International Searching Authority (KIPO) dated Aug. 28, 2015.

Manasson et al.; "Monolithic Electronically Controlled Millimeter-Wave Beam-Steering Antenna"; Digest of Papers of 1998 Topical Meeting on Silicon Monolithic Integrated Circuits in RF Systems, Sep. 17-18, 1998, pp. 215-217.

Manasson et al.; "MMW Scanning Antenna"; *IEEE Aerospace and Electronic Systems Magazine*, vol. 11, No. 10, pp. 29-33, Oct. 1996.

ELECTRONICALLY-CONTROLLED STEERABLE BEAM ANTENNA WITH SUPPRESSED PARASITIC SCATTERING

CROSS-REFERENCE TO RELATED APPLICATIONS

Not Applicable

FEDERALLY SPONSORED RESEARCH OR DEVELOPMENT

Not Applicable

BACKGROUND

The present disclosure relates to directional or steerable beam antennas, of the type employed in such applications as radar and communications. More specifically, it relates to leaky-waveguide antennas, of the type including a dielectric feed line (i.e., a potentially leaky waveguide) loaded with scatterers (antenna elements), where coupling between the scatterers and the feed line can be altered by switches, whereby the antenna's beam shape and direction are determined by the pattern of the switches that are respectively turned on and off.

Steerable antennas, particularly leaky-wave antennas, are capable of sending electromagnetic signals in, and receiving electromagnetic signals from, desired directions. Such antennas are used, for example, in various types of radar, such as surveillance radar and collision avoidance radar. In such antennas, the receiving or transmitting beam is generated by a set of scatterers coupled to the feed line or waveguide. Interacting with the feed line, the scatterers create leaky waves propagating outside of the feed line. If the scatterers are properly phased, they create a coherent beam propagating in a specific direction. The leakage strength and phase caused by each scatterer depend on the geometry and location of the scatterer relative to the feed line or waveguide. The coupling strength can be controlled by changing the geometry of the scattering elements. Correspondingly, the shape and direction of the scattered beam can be controlled by varying the scatterer geometry or topology. The geometry (topology) of the scatterers can be electronically altered by using microwave (or other suitable) switches connecting parts of the scatterers. Thus, the shape and direction of the antenna beam can be controlled electronically by changing the state of the switches. Different ON/OFF switch patterns result in different beam shapes and/or directions.

Any of several types of switches integrated into the structure of the antenna elements or scatterers may be used for this purpose, such as semiconductor switches (e.g., PIN diodes, bipolar and MOSFET transistors, varactors, photodiodes and photo-transistors, semiconductor-plasma switches, phase-change switches), MEMS switches, piezoelectric switches, ferro-electric switches, gas-plasma switches, electromagnetic relays, thermal switches, etc. For example, semiconductor plasma switches have been used in antennas described in U.S. Pat. No. 7,151,499, the disclosure of which is incorporated herein by reference in its entirety. A specific example of an antenna in which the geometry of the scattering elements is controllably varied by semiconductor plasma switches is disclosed and claimed in U.S. Pat. No. 7,777,286, the disclosure of which is incorporated herein in its entirety. Another example of a currently-available electronically-controlled steerable beam antenna using switchable antenna elements (scatterers) is disclosed in U.S. Pat. No. 7,995,000, the disclosure of which is incorporated herein its entirety.

FIG. 1 schematically illustrates a conventional steerable-beam antenna 10 comprising a single array 12 of switchable scatterers 14 coupled to a feed line or waveguide 16 extending along an axis x. Each of the scatterers 14 is switchable between an open state or state of low scattering L, and a closed state or state of high scattering H. Typically, in operation, the scatterers 14 will be selectively switched to low and high states to create a diffraction grating with P scatterers in each repetitive period Pd, where P includes N low-state scatterers and M high-state scatterers, and where d is the spacing between adjacent scatterers 14. In the illustrated example, the period P=5, comprising four L-scatterers and one H-scatterer. The resultant beam angle $\alpha$ will thereby be given by the equation (1):

$$\sin \alpha = \beta/k - \lambda/Pd \quad (1)$$

where $\beta$ is the wave propagation constant in the feed line 16, k is the propagation wave vector in a vacuum, and $\lambda$ is the wavelength in vacuum. It will thus be seen that, by selectively switching the scatterers 14 between a high state and a low state, the grating period Pd can be controllably varied, thereby controllably changing the beam angle $\alpha$ of the electromagnetic radiation emanating from the feed line 16.

The above-described antenna 10 may be viewed as a single array 12 of switchable scatterers 14 and a feed line 16 that feeds an electromagnetic signal to, or receives an electromagnetic signal from, the array 12. Each of the scatterers 14 is switchable between a low state L and a high state H. A specific pattern of H-state and L-state scatterers 14 represents a hologram that forms a coherent "leakage" (coupling between the free space and the feed line 16). By changing the pattern of H-states and L-states by means (for example) of a control signal source (not shown), the beam can be steered or manipulated in different ways, such as beam-steering, tracking, control of side lobes, multi-beam creation, control of beam width, etc.

In theory, in an ideal antenna, the L-state scatterers would not scatter electromagnetic power at all. In practice, however, real L-state scatterers still scatter a small amount of power. This so-called "parasitic" scattering degrades the desired steerable antenna beam, and may result in compromised radar resolution, detection of non-existing targets, etc. A beam pattern affected by parasitic scattering is illustrated graphically in FIG. 2, which charts relative antenna gain versus angle in a single array antenna. The steerable beam is labeled "A," and the accompanied parasitic edge scattering is labeled "B." The power level of the parasitic scattering is lower than that of the steerable beam A (about −20 dB relative to the peak gain of the steerable beam A in the illustrated example), but it still may degrade the antenna operation.

It would therefore be desirable to provide a mechanism for reducing the parasitic scattering in an electronically-controlled steerable beam antenna without measurably reducing the amplitude of the steerable beam.

SUMMARY

In one aspect, this disclosure relates to an electronically-controlled steerable beam antenna with suppressed parasitic scattering, comprising a feed line defining an axis x; and first and second arrays of electronically-controlled switchable scatters distributed along the axis x, each of the scatterers in the first and second arrays being switchable between a high state and a low state to scatter an electromagnetic wave propagating through the transmission line so as to form a steerable antenna beam; wherein each of the scatters of the second array is configured to be 180°-phase-shifted relative to a corresponding scatter of the first array; and wherein the switchable scatterers of the first and second arrays are configured into high states and low states relative to each other so as to suppress parasitic scattering of the electromagnetic wave without suppressing the steerable antenna beam.

In another aspect, this disclosure relates to a method of scattering an electromagnetic wave into a steerable antenna beam, in an electronically controllable steerable beam antenna including a feed line defining an axis x and a first array of electronically controlled scatterers arranged along a first side of the axis x, each of the scatterers in the first array being switchable between a high state and a low state, the method comprising providing a second array of electronically-controlled switchable scatters arranged along the opposite side of the axis x from the first array, the scatterers in the second array being switchable between a high state and a low state; phase-shifting the scatters of the second array 180° relative to the scatterers in the first array; and switchably configuring the scatterers in the first and second arrays into high states and low states relative to each other so as to suppress parasitic scattering of the electromagnetic wave without suppressing the steerable antenna beam.

More specifically, the disclosure relates to an electronically-controlled steerable beam antenna with suppressed parasitic scattering, comprising a feed or transmission line defining an axis x (which may be linear or curved), and first and second linear arrays of electronically-controlled switchable scatterers parallel to, and on opposite sides of, the axis x, wherein the scatterers of the first array are configured to scatter an electromagnetic wave propagating through the transmission line in given phases $\phi(x)$, wherein the scatterers of the second array are configured to scatter the propagating wave in phases opposite to the given phases (i.e., $\phi(x)+\pi$ radians, or 180° out of phase with respect to the given phases), and wherein the H-state scatterers in the first array follow the periodic or quasi-periodic pattern $H_1(x)$ with a period Pd (where d is the spacing between the scatterers along the axis x, and P is the number of scatterers per period, as in Equation (1) above), and the H-state scatterers in the second array follow the pattern $H_2(x)=H_1(x\pm Pd/2)$, i.e., a pattern that is shifted by one-half period (180°) along the x axis relative to the H-state scatterers in the first array. The parasitic scattering created by the L-state scatterers in the second array destructively interferes with, and thus suppresses, the parasitic scattering created by the L-state scatterers in the first array. The half-period shift of the H-state scatterers in the second array gives the H-state scatterers in the second array an additional 180° phase shift, so that the H-state scatterers in the second array scatter the propagated wave in phase with H-state scatterers in the first array, thereby avoiding the suppression of the steerable beam, and creating a constructive interference in the direction given by the desired angle $\alpha$ of the steerable beam.

DETAILED DESCRIPTION

Figure 1:
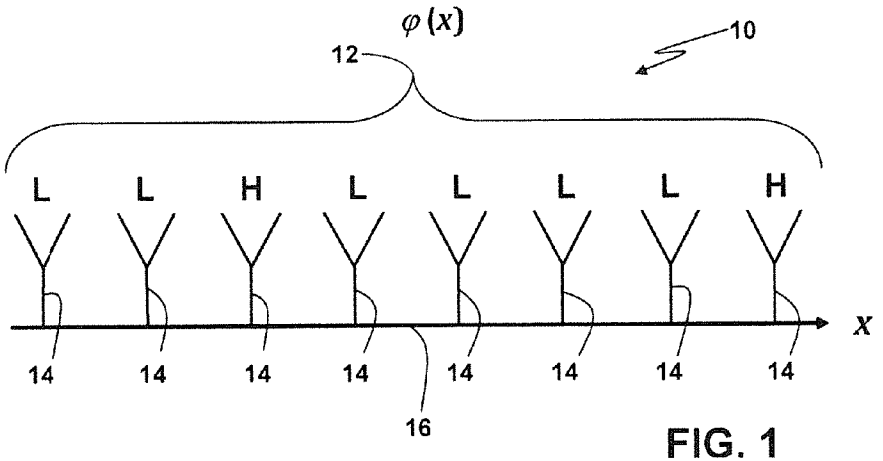
FIG. 1 (PRIOR ART)
FIG. 1 is a semi-schematic representation of a prior art electronically-controlled steerable beam antenna, employing a single linear array of scatterers.
Figure 3:
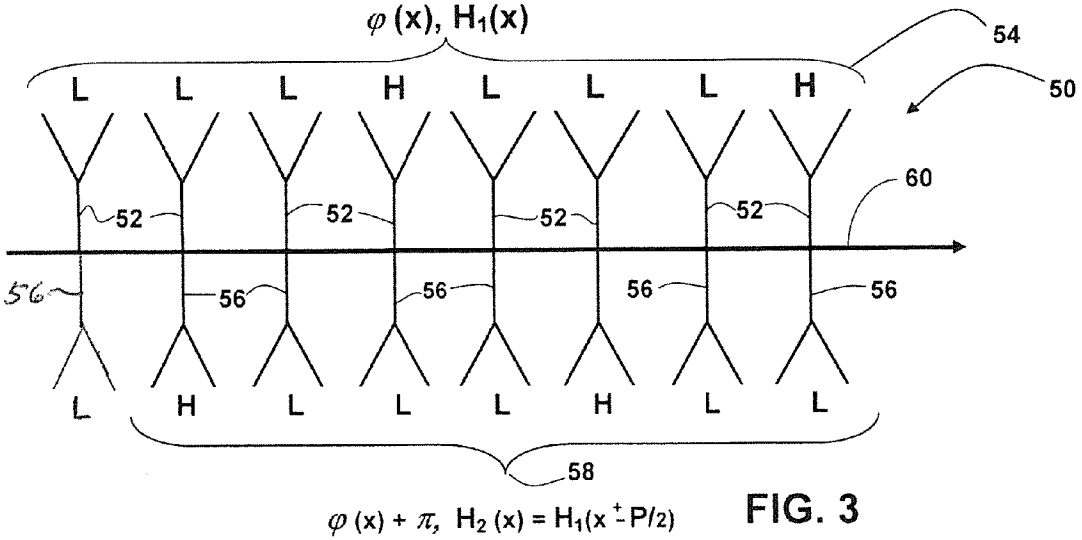
FIG. 3 is a diagrammatic representation of an electronically-controlled steerable beam antenna in accordance with the present disclosure, showing first and second scatterer arrays on either side of a transmission line defining an x axis, with the H-state pattern of the second array shifted relative to that of the first array by one half-period along the x axis.

FIG. 3 diagrammatically illustrates an electronically-controllable steerable beam antenna 50 in accordance with the present disclosure. The antenna 50 comprises a first plurality of scatterers 52 in a first linear array 54 and a second plurality of scatterers 56 in a second, complementary linear array 58. The first array 54 and the second array 58 are disposed parallel to, and on opposite sides of, a longitudinal feed line or transmission line 60 extending along an axis x. The scatterers 52, 56, as will be more specifically described below, are functionally similar to the scatterers 14 of the prior art antenna 10 described above and illustrated in FIG. 1, and thus are switchable between an L-state and an H-state. The scatterers 52 in the first array 54 are configured to scatter an electromagnetic wave propagating through the transmission line 60 in a given phase $\phi(x)$, while the scatterers 56 of the second array 58 are configured to scatter the propagating wave in a phase opposite to the given phase, i.e., $\phi(x)+\pi$ radians (180°). Thus configured, the parasitic scattering created by the L-state scatterers 56 in the second array 58 destructively interferes with, and thereby suppresses, the parasitic scattering created by the L-state scatterers 52 in the first array 54.

In operation, some of the scatterers 52 in the first array 54 will be switched to the H-state, as will the complementary scatterers 56 in the second array 58. To avoid destructive interference among the H-state scatterers, the H-state pattern $H_2(x)$ of the second array 58 of scatterers is shifted relative to the H-state pattern $H_1(x)$ of the first array 54 of scatterers by a distance equal to Pd/2 along the x axis. In the illustrated example, P=4; therefore, the shift of Pd/2 equals the distance of two scatterer separation distances. Thus, the H-state pattern in the second array may be expressed as $H_2(x)=H_1(x\pm Pd/2)$. This H-state pattern shift produces an additional phase shift of $\pi$ radians (180°) for the H-state scatters only in the direction of the steerable beam, and thus avoids destructive interference between the H-state scatterers in the first array 54 and the H-state scatterers in the second array 58 (and, in fact, may produce constructive interference between the H-state scatterers 52, 56 in each complementary pair). The result is that the antenna 50 produces the steerable beam in the desired direction and/or shape, but with strongly suppressed parasitic scattering.

Figure 4:
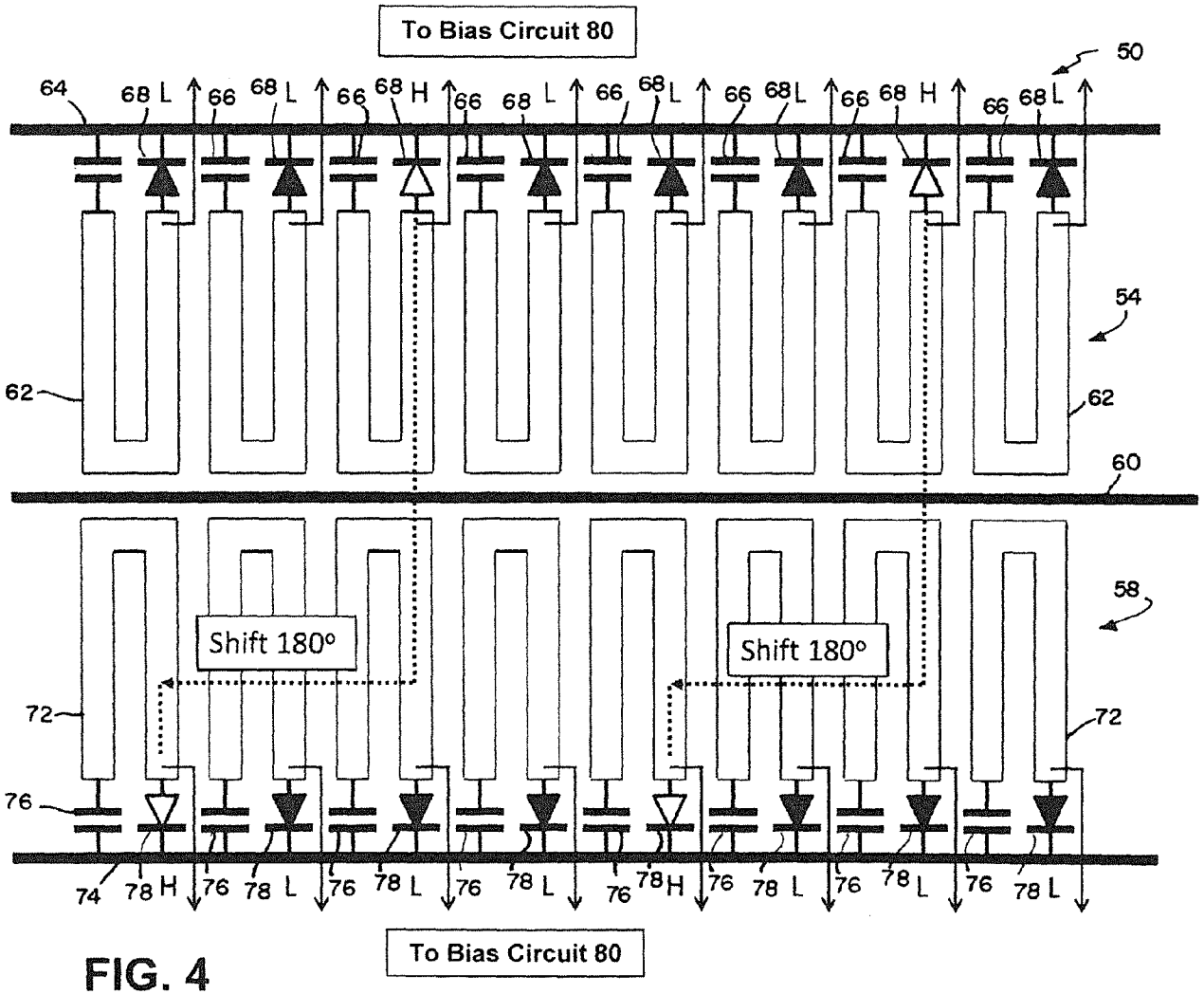
FIG. 4 is a simplified schematic view of an electronically-controlled steerable beam antenna, of the type represented in FIG. 3, in accordance with the present disclosure.
Figure 6:
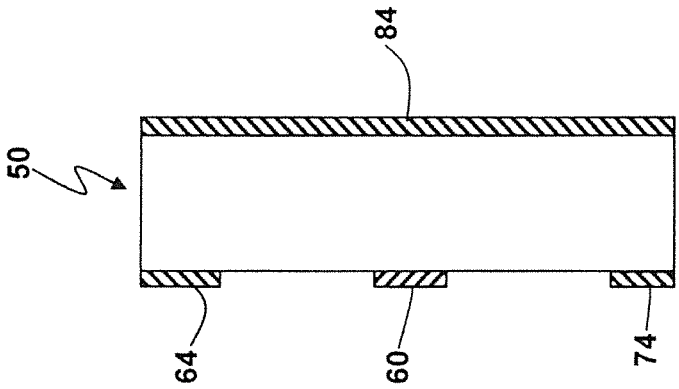
FIG. 6 is a simplified cross-sectional view of the physical embodiment shown in FIG. 5.
Figure 5:
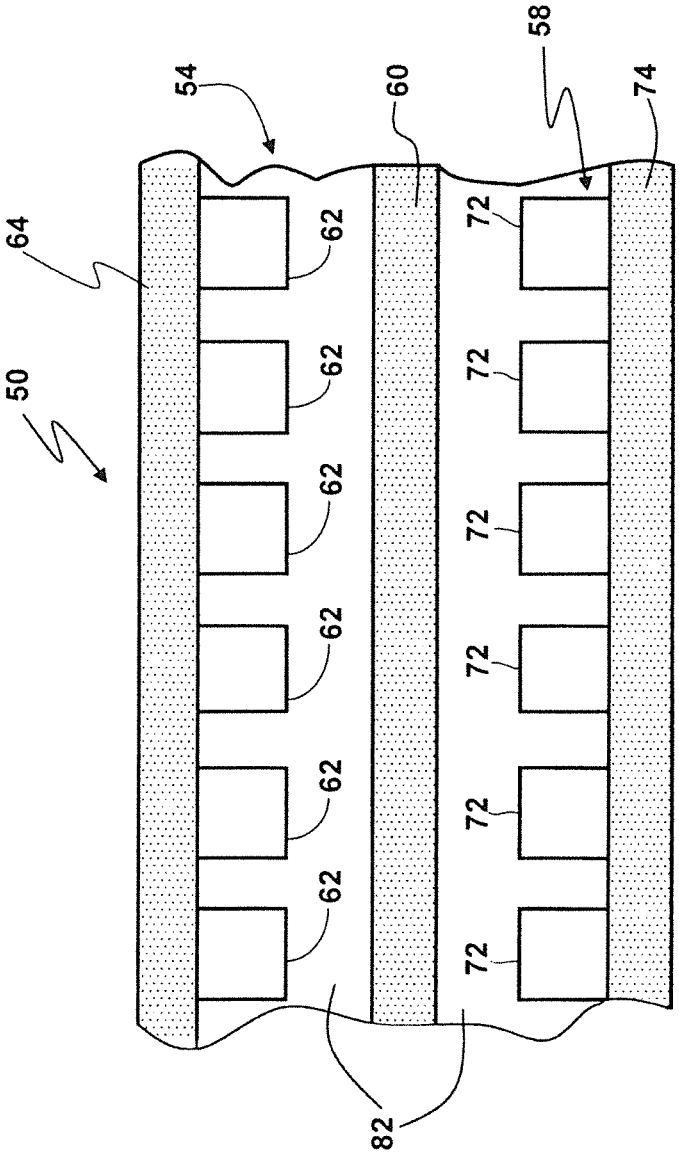
FIG. 5 is a simplified plan view of a physical embodiment of the antenna shown schematically in FIG. 4.

FIG. 4 shows an exemplary implementation of the antenna 50 shown diagrammatically in FIG. 3, in which the antenna components are disposed on a dielectric substrate (see FIGS. 5 and 6). The first scatterer array 54 is arranged longitudinally along one side of the feed or transmission line 60, and the second scatterer array 58 is arranged longitudinally along the opposite side of the feed or transmission line 60. Each of the first plurality of scatterers (i.e., those in the first array 54) comprises a conductive scatterer element 62, preferably configured as a U-shaped metallization area forming an open loop. Each of the first scatterer elements 62 has a first end connected to a first ground line 64 through a first grounding capacitor 66, and a second end connectable to the first ground line 64 through a first electronically controlled switch, represented, in this embodiment, by a PIN diode 68. Each of the second plurality of scatterers (i.e., those in the second array 58) likewise comprises a conductive scatterer element 72, preferably configured as a U-shaped metallization area forming an open loop. Each of the second scatterer elements 72 has a first end connected to a second ground line 74 through a second grounding capacitor 76, and a second end connectable to the second ground line 74 through a second electronically controlled switch, represented, in this embodiment, by a PIN diode 78. Other types of electronically controllable switching elements may be used instead of the PIN diodes 68, 78, as discussed above. Operation of the switches represented by the PIN diodes 68, 78 is controlled by a control signal circuit or bias circuit 80 under the control of an appropriately programmed processor or computer (not shown), as is well known in the art, e.g., U.S. Pat. No. 7,995,000, supra.

The arrangement of the components of the antenna part comprising the second array 58 of scatterers 72 is a mirror image of the arrangement of the components of the antenna part comprising the first array 54 of scatterers 62. Specifically, the conductive scatterer elements 62 in the first array 54 and the conductive scatterer elements 72 in the second array 58 are disposed back-to-back (mirror symmetry with respect to each other relative to the axis x); that is, the closed portion of each of the scatterer elements 62 in the first array 54 faces the closed portion of a corresponding scatterer element 72 in the second array 58 across the feed or transmission line 60, with the open ends of the scatterer elements 62, 72, in the first and second arrays 54, 58, respectively, facing away from the feed or transmission line 60. This arrangement creates the 180° phase shift between the scatterers 62 in the first array 54 and the scatterers 72 in the second array 58, which, as discussed above, results in the suppression of parasitic scattering. For transmission/reception of an electromagnetic wave having a wavelength $\lambda$, the total length of each conductive scatterer element 62, 72 is advantageously about $\lambda/2$, as corrected for the substrate material and the particular scatterer geometry.

The direction and the shape of the steerable antenna beam is controlled by switching the appropriate scatterers 62, 72 between the L-state and the H-state by means of the control signal circuit or bias circuit 80, as noted above. In FIG. 4, the L-state scatterers are indicated as those having PIN diodes 68, 78 represented by solid black symbols (filled triangles), while the H-state scatterers are indicated as those having PIN diodes 68, 78 shown in outline (unfilled triangles). If each of the H-state scatterers in the second array 58 were to be directly opposed to the corresponding H-state scatterer in the first array 54, the above-described 180° phase differential between the first and second arrays would tend to suppress the major beam along with the parasitic scattering as a result of destructive interference, thereby greatly attenuating the amplitude of the steerable beam. Therefore, as described above, and as shown in FIG. 4, the pattern of H-state and L-state scatterers in the second array 58 is shifted along the x-axis defined by the feed or transmission line 60 relative to the pattern of the first array 54 by half-period (Pd/2), so that each of the H-state scatterers in the second array 58 acquires an additional phase shift of $\pi$ radians (180°) and thus scatters in phase with the H-state scatterers of the first array 54.

FIGS. 5 and 6 show that the first and second scatterer arrays 54, 58, the feed or transmission line 60, and the first and second ground lines 64, 74 of the antenna 50 described above with reference to FIG. 4 may be formed or disposed on a dielectric substrate 82, by suitable means well-known in the art. For example, the conductive feed or transmission line 60, the ground lines 64, 74, and scatterer loops 62, 72 can be fabricated using printed circuit techniques. The capacitors 66 and 76 can be implemented as constructive elements or lumped components. An optional backing ground plate 84 may be provided (e.g., by printing or plating) to block backward antenna scattering.

The antenna 50 is reciprocal: it can operate in both transmitting mode and receiving mode. In the former case the feed line 60 is coupled to a transmitter (not shown); in the latter case the feed line is coupled to a receiver (not shown), as is well-known in the art.

Figure 8:
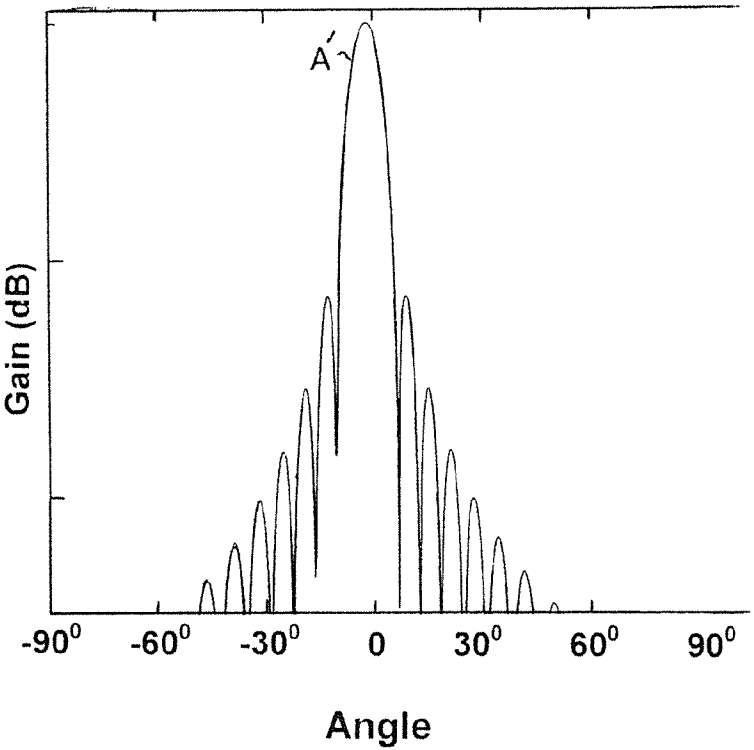
FIG. 8 is the antenna beam pattern for an antenna of the type shown in FIGS. 3-6, demonstrating suppression of the parasitic scattering, with the steerable beam designated as A'.
Figure 2:
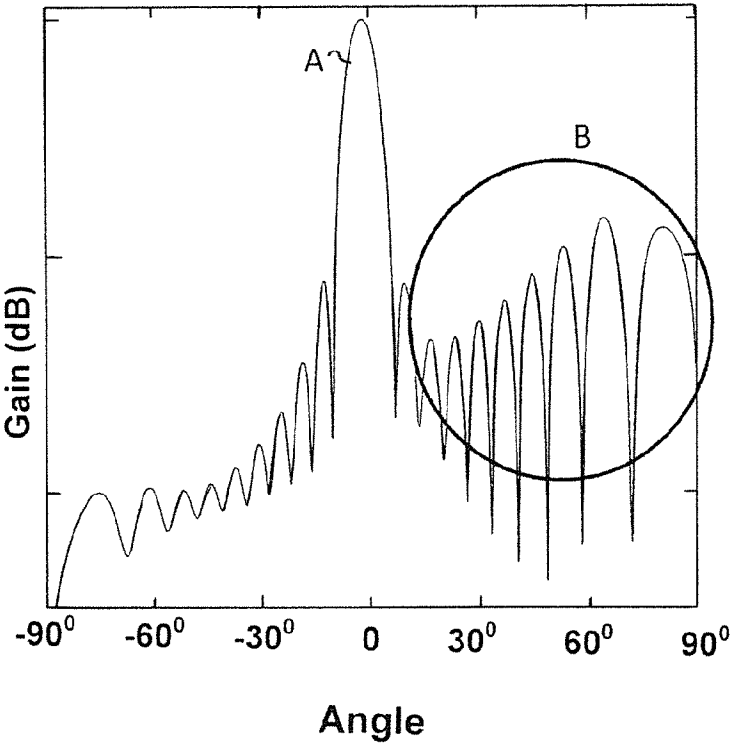
FIG. 2 (Prior Art)
FIG. 2 is a graphical representation of an antenna beam-pattern for a prior art antenna of the type shown in FIG. 1, with the steerable beam designated as A and parasitic scattering as B.
Figure 7A:
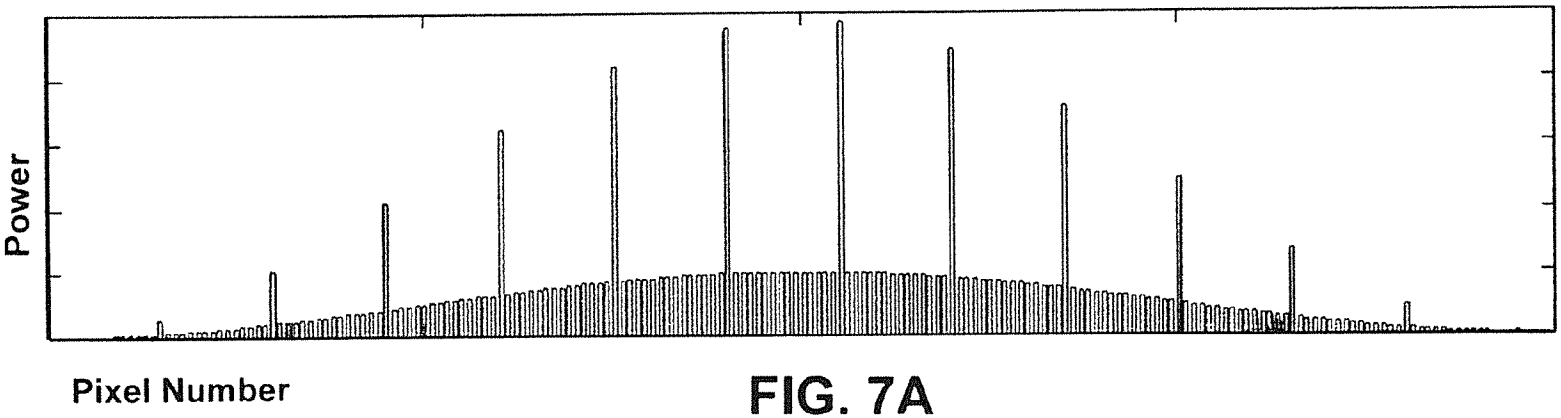
FIGS. 7A and 7B are graphical representations, respectively, of hologram patterns for the first and second scatterer arrays in simulations of the operation of an antenna in accordance with the present disclosure.
Figure 7B:
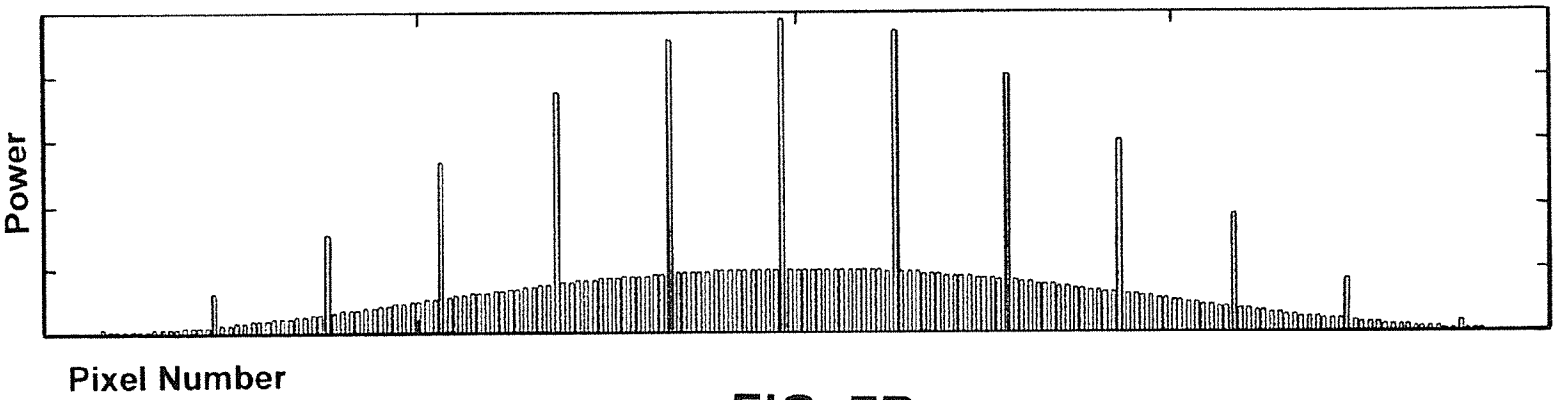

The performance of the antenna 50 shown in FIGS. 3-6, as described above, is illustrated in FIGS. 7A, 7B, and 8. FIGS. 7A and 7B respectively show the relative scattered power of the H-scatterers and the L-scatterers in the first and second arrays, as distributed along the axis x. As shown in FIGS. 7A and 7B, the scattered power from the L-scatterers of the first array is identical to the scattered power from the L-scatterers of the second array. The power pattern of the H-scatterers of the second array, however, is shifted one half-period relative to the pattern of H-scatterers of the first array. FIG. 8 shows that, contrasted with the performance of the prior art antenna (FIG. 2), the antenna structure of FIG. 4 exhibits a steerable antenna beam A' that is as strong as the steerable antenna beam A of FIG. 2. The parasitic beams, by contrast, are significantly attenuated relative to the parasitic beams of the prior art antenna (region B in FIG. 2).

What is claimed is:

1. An electronically-controlled steerable beam antenna with suppressed parasitic scattering, comprising:

a feed line defining an axis x; and first and second arrays of electronically-controlled switchable scatterers distributed along the axis x, each of the scatterers in the first and second arrays being switchable between a high state and a low state to scatter an electromagnetic wave propagating through the feed line so as to form a steerable antenna beam;

wherein each of the scatterers of the second array is configured to be phase-shifted 180° relative to a corresponding scatterer of the first array; and wherein the switchable scatterers of the first and second arrays are configured into high states and low states relative to each other so as to suppress parasitic scattering of the electromagnetic wave by the low state scatterers in the first array without suppressing the steerable antenna beam.

2. The antenna of claim 1, wherein each of the scatterers in the second array is at a defined position along the axis x and corresponds to a scatterer in the first array at the same defined position along the axis x.

3. The antenna of claim 1, wherein the high state scatterers in the first array follow a periodic pattern $H_1(x)$ with a period Pd, where d is the spacing between the scatterers along the axis x, and P is the number of scatterers per period, and wherein the high state scatterers in the second array follow the pattern $H_2(x)=H_1(x\pm Pd/2)$ along the axis x relative to the high state scatterers in the first array.

4. The antenna of claim 1, wherein the scatterers of the first array are distributed along a first side of the feed line, and the scatterers of the second array are distributed along a second, opposite side of the feed line.

5. The antenna of claim 4, wherein each of the scatterers in the first array comprises a conductive element having a first end electrically connected to a first ground line through a capacitor and second end electrically connected to the first ground line through an electronically controllable switch; and wherein each of the scatterers in the second array comprises a conductive element having a first end electrically connected to a second ground line through a capacitor and a second end electrically connected to the second ground line through an electronically controllable switch.

6. The antenna of claim 5, wherein the electronically controllable switches in the first and second arrays are PIN diodes.

7. The antenna of claim 5, wherein the conductive element of each of the scatterers in the first array and the conductive element of each of the scatterers in the second array are in mirror symmetry with respect to each other relative to the axis x.

8. An electronically-controlled steerable beam antenna with suppressed parasitic scattering, comprising:

a feed line defining an axis x; and a first array of electronically-switchable scatters distributed along the axis x, each of the scatterers in the first array being switchable between a high state and a low state to form a first pattern of high-state scatterers and low-state scatterers that provides an electromagnetic wave propagating through the feed line so as to form a steerable antenna beam;

a second array of electronically-switchable scatterers distributed along the axis x parallel to the first array, each of the scatterers in the second array being switchable between a high state and a low state to form a second pattern of high-state scatterers and low state scatterers in which the scatterers of the second array are configured to be phase-shifted 180° relative to the scatterers in the first array, and in which the high-state scatterers of the second array are configured to be further phase-shifted relative to the high-state scatterers in the first array, so as to suppress parasitic scattering of the electromagnetic wave by the low state scatterers in the first array without suppressing the steerable antenna beam.

9. The antenna of claim 8, wherein each of the scatterers in the first array is at a defined position along the axis x, and wherein the second array includes a corresponding scatterer at the same defined position along the axis x as each of the scatterers in the first array.

10. The antenna of claim 8, wherein the first pattern includes high state scatterers that follow a periodic pattern $H_1(x)$ with a period Pd, where d is the spacing between the scatterers in the first array along the axis x, and P is the number of scatterers per period, and wherein the second pattern includes high-state scatterers that follow the pattern $H_2(x)=H_1(x\pm Pd/2)$ along the axis x relative to the high-state scatterers in the first pattern.

11. The antenna of claim 8, wherein the scatterers of the first array are distributed along a first side of the feed line, and the scatterers of the second array are distributed along a second, opposite side of the feed line.

12. The antenna of claim 11, wherein each of the scatterers in the first array comprises a conductive element having a first end electrically connected to a first ground line through a capacitor and second end electrically connected to the first ground line through an electronically controllable switch; and wherein each of the scatterers in the second array comprises a conductive element having a first end electrically connected to a second ground line through a capacitor and a second end electrically connected to the second ground line through an electronically controllable switch.

13. The antenna of claim 12, wherein the electronically controllable switches in the first and second arrays are PIN diodes.

14. The antenna of claim 12, wherein the conductive element of each of the scatterers in the first array and the conductive element of each of the scatterers in the second array are in mirror symmetry with respect to each other relative to the axis x.

15. An electronically-controlled steerable beam antenna with suppressed parasitic scattering, comprising:

a feed line defining an axis x; and a first array of electronically-controlled switchable scatterers distributed along the axis x, each of the scatterers in the first array being switchable between a high state and a low state, wherein the scatterers in the first array define a first pattern of high state scatterers and low state scatterers, whereby an electromagnetic wave propagating through the feed line is scattered to form a steerable antenna beam having a direction defined by the first pattern; and a second array of electronically-controlled switchable scatterers distributed along the axis x, each of the scatterers in the second array being switchable between a high state and a low state to define a second pattern of high state scatterers and low state scatterers that are phase-shifted 180° relative to the high state scatterers and low state scatterers in the first array so as to suppress parasitic scattering of the propagated electromagnetic wave by the low state scatterers in the first array without suppressing the steerable antenna beam.

16. The antenna of claim 15, wherein each of the scatterers in the second array is at a defined position along the axis x and corresponds to a scatterer in the first array at the same defined position along the axis x.

17. The antenna of claim 15, wherein the high state scatterers in the first array are configured in a first periodic pattern $H_1(x)$ with a period Pd, where d is the spacing between the scatterers along the axis x, and P is the number of scatterers per period, and wherein the high state scatterers in the second array are configured in a second periodic pattern $H_2(x)=H_1(x\pm Pd/2)$ along the axis x relative to the high state scatterers in the first array.

18. The antenna of claim 15, wherein the scatterers of the first array are distributed along a first side of the feed line, and the scatterers of the second array are distributed along a second, opposite side of the feed line.

19. The antenna of claim 18, wherein each of the scatterers in the first array comprises a conductive element having a first end electrically connected to a first ground line through a capacitor and second end electrically connected to the first ground line through an electronically controllable switch; and wherein each of the scatterers in the second array comprises a conductive element having a first end electrically connected to a second ground line through a capacitor and a second end electrically connected to the second ground line through an electronically controllable switch.

20. The antenna of claim 19, wherein the electronically controllable switches in the first and second arrays are PIN diodes.

21. The antenna of claim 19, wherein the conductive element of each of the scatterers in the first array and the conductive element of each of the scatterers in the second array are in mirror symmetry with respect to each other relative to the axis x.

22. A method of providing a steerable antenna beam in an electronically controllable steerable beam antenna including a feed line defining an axis x and a first array of electronically controlled scatterers arranged along a first side of the axis x, each of the scatterers in the first array being switchable between a high state and a low state to define a first pattern of high state scatterers and low state scatterers that scatters an electromagnetic wave propagating through the feed line into a steerable antenna beam at a desired angle relative to the x axis, the method comprising:

providing a second array of electronically-controlled switchable scatters arranged along the opposite side of the axis x from the first array, the scatterers in the second array being switchable between a high state and a low state; and switchably configuring the scatterers in the second array into high states and low states in a second pattern that is phase-shifted relative to 180° relative to the first pattern so as to suppress parasitic scattering of the electromagnetic wave by the low state scatterers in the first array without suppressing the steerable antenna beam.

23. The method of claim 22, wherein the scatterers in the first array are controllably switched so as to provide a first periodic pattern of high-state scatterers defined by $H_1(x)$ with a period Pd, where d is the spacing between the scatterers along the axis x, and P is the number of scatterers per period; and wherein switchably configuring the scatterers of the second array comprises controllably switching the scatterers of the second array to provide a second periodic pattern of high state scatterers defined by $H_2(x)=H_1(x\pm Pd/2)$ along the axis x axis relative to the first periodic pattern.

* * * * *